United States Patent [19]

Jatkar et al.

[11] Patent Number: 4,624,705

[45] Date of Patent: Nov. 25, 1986

[54] MECHANICAL ALLOYING

[75] Inventors: Arun D. Jatkar, Monroe; Paul S. Gilman, Suffern, both of N.Y.; Raymond C. Benn, Huntington, W. Va.

[73] Assignee: Inco Alloys International, Inc., Huntington, W. Va.

[21] Appl. No.: 848,162

[22] Filed: Apr. 4, 1986

[51] Int. Cl.[4] ..... C22C 29/02

[52] U.S. Cl. ..... 75/239; 75/236; 75/240; 148/11.5 P; 148/11.5 Q; 419/11; 419/17; 419/28; 419/33; 419/62; 419/66; 420/528; 420/552

[58] Field of Search ..... 75/236, 239, 240; 148/11.5 P, 11.5 Q; 419/11, 17, 28, 33, 62, 66; 420/528, 552

[56] References Cited

U.S. PATENT DOCUMENTS

| | | | |
|---|---|---|---|
| 4,292,079 | 9/1981 | Pickens et al. | 419/11 |
| 4,532,106 | 7/1985 | Pickens | 419/19 |
| 4,557,893 | 12/1985 | Jatkar et al. | 419/12 |

*Primary Examiner*—Stephen J. Lechert, Jr.
*Attorney, Agent, or Firm*—Francis J. Mulligan, Jr.; Raymond J. Kenny

[57] ABSTRACT

Aluminum-base alloys and a method of preparing aluminum-base alloys by mechanical alloying in the presence of a carbidiferous processing aid wherein a strong carbide former such as titanium is included so as to produce carbides in the final alloy more thermally stable at temperatures in excess of 100° C. than $Al_4C_3$.

8 Claims, No Drawings

MECHANICAL ALLOYING

The present invention is concerned with the manufacture of aluminum-base alloys having useful characteristics at temperatures up to about 480° C. by virtue of incorporating carbides, more stable than aluminum carbide in the alloys at those temperatures.

PRIOR ART AND PROBLEM

High strength aluminum-base alloys i.e., alloys containing greater than 50% by weight aluminum have been made by mechanical alloying techniques which alloys have useful mechanical characteristics at room temperature. These alloys depend in part for strength on age hardened and/or work hardened internal structures and, in part, on the formation, in-situ, of a fine dispersion of aluminum carbide ($Al_4C_3$) and aluminum oxide by reaction of aluminum with the break-down products of a carbon-containing processing aid (e.g., stearic acid) used in the mechanical alloying process. On exposure to temperatures above about 100° C., age-hardened structures and/or work hardened tend to soften and at higher temperatures the dispersion of $Al_4C_3$ in the alloy tends to coarsen, thus lessening the contribution of carbide to the strength of the alloy. In consequence, aluminum-base allovs of the prior art as produced by mechanical alloying are not generally suitable for use in the temperature range of 100° C. to 480° C. The present invention has for its object, the provision and production of mechanically alloyed, aluminum-base alloys suitable for use in this temperature range.

GENERAL DESCRIPTION OF THE INVENTION

Broadly, the present invention contemplates including in the mechanical alloying charge for an aluminum-base alloy, a material in microfine dispersion or readily transformable to a microfine dispersion which comprises or contains a carbide-forming element from the group of titanium, niobium, zirconium, vanadium, hafnium and molybdenum, along with aluminum and other alloying elements, mechanically alloying such charge in the presence of a carbon-containing processing aid to thereby mechanically alloy the charge and form, in-situ within the alloyed charge a dispersion of carbidiferous material incorporating metal of the aforementioned group, said carbidiferous material being present as dispersed particles less than about 500 A in major dimension and said dispersion being resistant to coarsening at temperatures above 200° C. and even above about 370° C. The invention also contemplates the alloys made by the aforedescribed process. Advantageously the carbide-forming element is present in the alloy produced in an amount at least equal to the stoichiometric amount minimally necessary to combine with carbon present in the alloy. For example, in the case of vanadium where two carbides VC and $V_2C$ are known, the amount of vanadium in the alloy advantageously is at least that amount calculated from the formula VC.

For purposes of this specification and claims the term "mechanical alloying" is employed to mean a process in which a charge of powder ingredients is subjected to impacts by an impacting medium so as to cause a multiplicity of particle weldings and fracturing until the charge is converted to an essentially uniform powder product. While attritors and horizontal ball mills are most often used for mechanical alloying, for purposes of the invention the particular apparatus used is immaterial. The product of mechanical alloying is thereafter compressed, sintered and worked as disclosed hereinafter.

The term "carbidiferous material" is employed to include not only simple carbides e.g., TiC, VC, $V_2C$, NbC, $Nb_2C$, but also compounds and mixtures such as carbonitrides, carbides containing free carbon and carbidic species formed from the association of stable carbides with one or more ingredients of alloys contemplated herein.

Again for purposes of the present specification and claims, the term "microfine dispersion" means a dispersion having particle sizes significantly below 5 micrometers (μm) average particle size and more preferably below about 1 μm in particle size. Additions of strong carbide former to the mechanical alloying charge can thus be in the form of dust or fume size particles of elements or compounds or alloys of elements mentioned hereinbefore or in the form of larger size, brittle materials (e.g., intermetallic compounds) which are readily broken down by mechanical impact in the mechanical alloying process to particles less than 1 μm or, more preferably, less than 0.8 μm in average dimension.

Carbon-containing processing aids useful in mechanical alloying of aluminum-base alloys include stearic acid, methanol, graphite, oxalic acid, etc.

It is advantageous to employ in the mechanical alloying charge a powder of a brittle intermetallic compound containing the carbide-forming element. Examples of such brittle, intermetallic compounds are $VAl_3$, $TiAl_3$, $ZrAl_3$, $NbAl_3$, FeTi, $Fe_{0.85}Mn_{0.15}Ti$, $Ti_2Ni$, $Ti_5Si_3$, $Zr_2Si$ and $TiFe_2$. It is also advantageous to employ carbide-forming elements in the form of rapidly solidified particulates of alloys of the carbide-forming elements and other metals. Such particulates may have the characteristics of amorphous "glassy" alloys or supersaturated solid solution alloys or may contain almost microscopically indistinguishable crystallites of a solid phase or phases normally existing at or just below the liquidus of the particular alloy system employed.

Powder charges in accordance with the present invention are all processed by mechanical alloying. This technique can be a high energy milling process, which is described in U.S. Pat. Nos. 3,591,362, 3,740,210 and 3,816,080 (among others). Briefly, the aluminum-base alloy is prepared by subjecting a powder charge to dry, high energy milling in the presence of a grinding medium, e.g., balls, and a process control agent, under conditions sufficient to comminute the powder particles of the charge, and through a combination of comminution and welding actions caused repeatedly by the milling, to create new, dense, composite particles containing fragments of the initial powder material intimately associated and uniformly interdispersed. Milling is done in a protective atmosphere, e.g., under an argon or nitrogen blanket, thereby facilitating oxygen control since virtually the only sources of oxygen are the starting powders and the process control agent. The process control agent is a weld-controlling amount of a carbon-contributing agent. The formation of dispersion strengthened mechanically alloyed aluminum is given in detail in U.S. Pat. Nos. 3,740,210 and 3,816,080, mentioned above. Suitably the powder is prepared in an attritor using a ball-to-powder weight ratio of 15:1 to 60:1. Preferably process control agents are methanol, stearic acid or graphite. Carbon from these organic compounds and/or graphite is incorporated in the powder and contributes to the dispersoid content. Carbide forming elements should be present in the charge at least in an amount approximately that stoichiometrically equivalent to about one half of the carbon entering the charge and up to about 200% or more in excess of the stoichiometric equivalent of the carbon entering the charge. Generally it is possible to charge all ingredients into a mill along with processing aid and carry out mechanical alloying in a single continuous operation. On occasion it is advantageous to mechanically alloy an aluminum-rich fraction of the mill charge for a significant amount of time prior to introducing into the mill harder ingredients of the charge.

Unless extreme, commercially unrealistic precautions are taken, the alloys of the present invention produced by the process of the present invention contain oxygen in the form of stable metal oxides, e.g. $Al_2O_3$. This oxygen is derived from oxide present on the powder particles introduced into the mechanical alloying apparatus, from the atmosphere present in the apparatus during mechanical alloying and, usually, from the processing aid used. While in theory it may be possible to supply metal, e.g. aluminum, powder free of oxide film and mechanically alloy such powder in an atmosphere totally devoid of oxygen, e.g. an atmosphere of argon with an oxygen-free processing aid, e.g. pure graphite or an alkane, carrying out such a process on an industrial scale would be impractical unless the ultimate consumers were willing to pay extraordinary high prices for low-oxygen alloys. In the ordinary course of events it is possible to minimize the amount of oxygen included in the mechanically alloyed alloys of the invention by utilizing starting aluminum powder of relatively large, regular particle size, controlling the mill atmosphere to largely exclude oxygen and externally derived carbon oxides and water vapor and by using a processing aid containing a low amount of oxygen, e.g. stearic acid. Specifically stearic acid contains about 11% by weight oxygen. Accordingly use of about 2% by weight (of metal) of stearic acid as a processing aid will contribute about 0.23% of oxygen to the metal being mechanically alloyed. In alloys of the invention, oxygen in an amount up to about 1% or even higher is not necessarily bad. Accordingly when it is desired to have oxygen contents on the high side one may very well select a processing aid such as oxalic acid which, as the monohydrate, contains about 64% oxygen. The carbon content of the alloys of the present invention is derived primarily or exclusively from the processing aid. Use of 2% stearic acid as a processing aid will contribute about 1.4% carbon to a mechanically alloyed charge. However a portion of this carbon may not report in the product alloy because of the formation of carbon oxides which may escape from the milling means.

After mechanical alloying is complete and before the dispersion strengthened mechanically alloyed product is consolidated it must be degassed and compacted. Degassing and compacting are effected under vacuum and generally carried out at a temperature in the range of about 480° C. (895° F.) up to just below incipient liquification of the alloy. The degassing temperature should be higher than any temperature to be subsequently experienced by the alloy. Degassing is preferably carried out, for example, at a temperature in the range of from about 480° C. (900° F.) up to 545° C. (1015° F.) and more preferably above 500° C. (930° F.). Pressing is carried out at a temperature in the range of about 545° C. (1015° F.) to about 480° C. (895° F.).

In a preferred embodiment the degassing and compaction are carried out by vacuum hot pressing (VHP). However, other techniques may be used. For example, the degassed powder may be upset under vacuum in an extrusion press. To enable powder to be extruded to substantially full density, compaction should be such that the porosity is isolated thereby avoiding internal contamination of the billet by the extrusion lubricant. This is achieved by carrying out compaction to at least about 95% of full density. Preferably the powders are compacted to 99% of full density and higher, that is, to substantially full density.

The resultant compaction products formed in the degassing and compaction step or steps are then consolidated.

Consolidation is carried out by extrusion. The extrusion of the material not only is necessary to insure full density in the alloy, but also to break up surface oxide on the particles. The extrusion temperature may be of significance in that control within a narrow temperature established for each alloy may optimize mechanical characteristics. Lubrication practice and the exact die-type equipment used for extrusion can also be of significance to mechanical characteristics. Hot compaction and hot consolidation each alone or together with heating cycles serve to totally sinter bond the product of mechanical alloying and together provide a body of substantially full density.

After extrusion, billets can be forged. If necessary, the billets may be machined to remove surface imperfections. Following forging and before or after any finishing operations the alloy can be age-hardened if it is amenable to age-hardening. Those skilled in the art will appreciate that alloys of the invention containing carbides more thermally stable than aluminum carbide may be used in the extruded condition as well as in the forged condition. Thus heat treatment, if any, is carried out after the last appropriate working operation.

In practicing the present invention, it is advantageous to use titanium as the carbide-forming ingredient added to the mechanical alloying charge. Titanium is highly advantageous in that it has a relatively low density and its carbide has a high negative heat of formation. Vanadium is a second choice based principally on density. It is to be appreciated that when an oxygen-containing process control agent such as stearic acid is used in the mechanical alloying operation, carbon monoxide, water vapor and carbon dioxide will exist in the mill atmosphere as breakdown products of the process control agent. Under such circumstances, titanium will compete with aluminum as an oxide former and therefor the amount of titanium available to form carbides will be less than if graphite or an oxygen-poor hydrocarbon is used as process control agent.

In order to give those skilled in the art a further appreciation of the advantage of the present invention, the following examples are given.

EXAMPLES

Compositions to be prepared by mechanical alloying in percent by weight as set forth in Table I.

TABLE I

| Alloy No. | Al | Mg % | Li % | Si % | Carbide Former | Carbide Former (%) | Processing Aid |
|---|---|---|---|---|---|---|---|
| 1 | Bal | — | — | — | Ti | 1.5 | Methanol |
| 2 | Bal | — | — | — | V | 1.8 | Same |

TABLE I-continued

| Alloy No. | Al | Mg % | Li % | Si % | Carbide Former | Carbide Former (%) | Processing Aid |
|---|---|---|---|---|---|---|---|
| 3 | Bal | — | — | — | Nb | 3.0 | Same |
| 4 | Bal | — | — | — | Zr | 2.4 | Same |
| 5 | Bal | — | — | — | Ti | 4.0 | Stearic Acid |
| 6 | Bal | — | 2.6 | — | Ti | 2.5 | Stearic Acid |
| 7 | Bal | — | 1.9 | — | FeTi | 5.5 | Same |
| 8 | Bal | 4 | — | — | $Al_3Ti$ | 6.8 | Same |
| 9 | Bal | 4 | 1.5 | — | $Al_3Ti$ | 6.8 | Same |
| 10 | Bal | 4 | 1.5 | — | FeTi | 5.0 | Same |
| 11 | Bal | 4 | 1.5 | 0.5 | $Al_3Ti$ | 20 | Graphite and Stearic Acid |
| 12 | Bal | 2 | 2 | — | FeTi | 7.6 | Graphite and Stearic Acid |
| 13 | Bal | 2 | 2 | — | $Ti_5Si_3$ | 3.4 | Stearic Acid |

The amount of processing aid is generally between 1% and 2% by weight. After mechanical alloying, the charges of the foregoing Table are degassed, compacted and extruded as disclosed hereinbefore to provide product which contains a refractory oxide and in which a significant amount of carbon is present as a carbide more thermally stable at temperature in the range of 100° C. to about 480° C. than aluminum carbide.

Additional compositions to be prepared by mechanical alloying using between about 1% and 2% of processing aid as set forth in Table I are presented in Table II.

TABLE II

| Alloy | Cr | Mn | Ti | Fe | Cu | Ni | V | Si | Al |
|---|---|---|---|---|---|---|---|---|---|
| 14 | 7 | — | 1.8 | — | — | — | — | — | Bal |
| 15 | 7 | — | — | — | — | — | 2.5 | — | Bal |
| 16 | — | 5 | 2.5 | — | — | — | — | — | Bal |
| 17 | — | 5 | 2.0 | — | — | 5 | — | — | Bal |
| 18 | — | 2.5 | 1.6 | — | 6 | — | 0.1 | — | Bal |
| 19 | — | — | 2.0 | 7.5 | — | — | — | — | Bal |
| 20 | 2.0 | — | 1.6 | 7.5 | — | — | — | — | Bal |
| 21 | — | 5.0 | 3.8 | — | — | — | — | — | Bal |
| 22 | — | — | 1.6 | 7.5 | — | — | — | — | Bal |
| 23 | — | 2 | 2.5 | 1 | — | 6 | — | — | Bal |

Precursors of the compositions of Table II are made by melting aluminum together with any one or more of chromium, molybdenum, tungsten, manganese, titanium, iron, cobalt, nickel and vanadium (i.e., elements having a low diffusion rate in solid aluminum at temperatures above about 300° C.) together with copper and silicon, if any, to form a uniform molten composition and atomizing the molten metal to form alloy powder. This step is taught in any one or more of U.S. Pat. Nos. 2,966,731, 2,966,732, 2,966,733, 2,966,734, 2,966,735, 2,966,736 and 2,967,351 the disclosures of which are incorporated herein by reference. The atomized powder thus formed is then subjected to mechanical alloying in the presence of a carbon-containing processing aid to include therein dispersion of a carbidiferous material more stable than aluminum carbide and, usually, a refractory oxide containing aluminum. The resultant mechanically alloyed powder is then compacted, sintered and worked to the desired configuration as described hereinbefore. After mechanical alloying, the charges of the foregoing Table are degassed, compacted and extruded as disclosed hereinbefore to provide product in which a significant amount of carbon is present as a carbide more thermally stable at temperature in the range of 370° C. to about 480° C. than aluminum carbide.

Supplementing or in part substituting for stabilization of carbides is the addition of a rare earth element or elements to high temperature aluminum-base alloys. Thus it is within the contemplation of the present invention to incorporate in a mechanical alloying charge for a high temperature aluminum-base alloy about 0.01 to about 0.2% by weight of one or more metals of the rare earth group. The metal is advantageously yttrium or lanthanum or a commercially available mixture of rare earth metals such as mischmetal, cerium-free mischmetal or lanthanum-free mischmetal. Illustrative compositions in percent by weight are set forth in Table III.

TABLE III

| Alloy | A (%) | B (%) | C (%) | D (%) |
|---|---|---|---|---|
| Mg | 4 | 4 | 4 | 2 |
| Li | 1.5 | 1.5 | 1.75 | 2 |
| Si | 0.5 | 0.5 | — | — |
| Rare Earth | 0.1 | 0.1 | 0.1 | 0.15 |
| Carbide Former | — | (Ti) 5.0 | (V) 5.5 | (Ti) 5.5 |
| Al | Bal E* | Bal E* | Bal E* | Bal E* |

*Bal E means balance essentially which includes minor amounts of other elements and ingredients which do not affect the basic and novel characteristics of the alloy together with amounts of carbon and oxygen normally present in mechanically alloyed aluminum compositions.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property of privilege is claimed are defined as follows:

1. A sintered and worked aluminum-base alloy adapted to be used at temperatures in excess of about 100° C., the powder precursor of said alloy having been subjected to mechanical alloying in the presence of a carbon-containing processing aid and said alloy being characterized by containing a dispersion formed in situ of particles less than about 500 A in major dimension of a carbidiferous material more stable than $Al_4C_3$ at temperatures above 100° C. in an aluminum matrix and said carbidiferous material containing a metal from the group of titanium, niobium, vanadium and zirconium.

2. An aluminum-base alloy as in claim 1 wherein said carbidiferous material contains titanium.

3. An aluminum-base alloy as in claim 1 wherein said metal from the group of titanium, niobium, vanadium and zirconium is present in an amount at least equal to the stoichiometric amount minimally necessary to combine with carbon present in said alloy.

4. An aluminum-base alloy as in claim 1 which contains at least one element having a low rate of diffusion in solid aluminum at temperatures above about 300° C.

5. An aluminum-base alloy as in claim 1 containing about 0.01% to 0.2% by weight of rare earth.

6. A process for producing sintered and worked aluminum-base alloy to be used at temperatures in excess of about 100° C. comprising including in a mechanical alloying charge for an aluminum-base alloy a material in microfine dispersion or in a form readily convertable to a microfine dispersion under mechanical alloying conditions containing a carbide-forming element from the group of titanium, vanadium, niobium and zirconium, mechanically alloying said charge in the presence of a carbon-containing processing aid and thereafter compressing and hot working the thus produced mechanically alloyed product to substantially full density.

7. A process as in claim 6 wherein said carbide-forming element is titanium.

8. A process as in claim 6 wherein said mechanical alloying charge contains about 0.01% to about 0.20% of rare earth metal.

* * * * *